US010480286B2

(12) United States Patent
Norman et al.

(10) Patent No.: US 10,480,286 B2
(45) Date of Patent: Nov. 19, 2019

(54) MULTI-ZONE FRACTURING WITH FULL WELLBORE ACCESS

(71) Applicant: Halliburton Energy Services, Inc., Houston, TX (US)

(72) Inventors: Tyler J. Norman, Duncan, OK (US); Zachary W. Walton, Carrollton, TX (US); Matt James Merron, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 228 days.

(21) Appl. No.: 15/538,028

(22) PCT Filed: Feb. 6, 2015

(86) PCT No.: PCT/US2015/014779
§ 371 (c)(1),
(2) Date: Jun. 20, 2017

(87) PCT Pub. No.: WO2016/126262
PCT Pub. Date: Aug. 11, 2016

(65) Prior Publication Data

US 2017/0350214 A1 Dec. 7, 2017

(51) Int. Cl.
*E21B 34/14* (2006.01)
*E21B 43/14* (2006.01)
(Continued)

(52) U.S. Cl.
CPC ..... *E21B 34/14* (2013.01); *E21B 43/11* (2013.01); *E21B 43/14* (2013.01); *E21B 43/26* (2013.01);
(Continued)

(58) Field of Classification Search
CPC .... E21B 34/14; E21B 43/26; E21B 2034/007; E21B 43/14
See application file for complete search history.

(56) References Cited

U.S. PATENT DOCUMENTS 7,322,417 B2 1/2008 Rytlewski et al.
8,201,631 B2 6/2012 Stromquist et al.
(Continued)

FOREIGN PATENT DOCUMENTS

WO 2002/006629 A1 1/2002
WO 2014082054 A1 5/2014

OTHER PUBLICATIONS

Search report issued in related Danish application No. 201700327, dated Mar. 27, 2018 (7 pages).
(Continued)

*Primary Examiner* — Catherine Loikith
(74) *Attorney, Agent, or Firm* — John W. Wustenberg; Baker Botts L.L.P.

(57) ABSTRACT

A system and method for fracturing multiple zones along a length of a wellbore during a single run are provided. A single mechanical shifter device may be lowered on coiled tubing to shift open multiple sleeve assemblies set along the wellbore to expose different fracture zones for desired fracturing treatments. The sleeve assemblies may each include a shifting sleeve designed for engagement with the mechanical shifter device. The mechanical shifter device may move the shifting sleeve along the wellbore to collapse a baffle component of the sleeve assembly. Once the baffle is collapsed, an isolation component of the shifter device may engage the collapsed baffle to form a plug through the wellbore. Pressure applied from the surface may push the baffle and a sliding sleeve of the sleeve assembly downward, thereby exposing fracturing ports through the casing of the
(Continued)

wellbore. Fracturing applications may then be performed through the ports.

18 Claims, 9 Drawing Sheets

(51) Int. Cl.

| | |
|---|---|
| ***E21B 43/26*** | (2006.01) |
| ***E21B 43/11*** | (2006.01) |
| *E21B 34/00* | (2006.01) |
| *E21B 33/12* | (2006.01) |

(52) U.S. Cl.
CPC ..... *E21B 33/12* (2013.01); *E21B 2034/007* (2013.01)

(56) References Cited

U.S. PATENT DOCUMENTS

| | | | |
|---|---|---|---|
| 10,364,649 | B2 * | 7/2019 | Norman ..... E21B 34/063 |
| 2006/0124310 | A1 | 6/2006 | Lopez de Cardenas et al. |
| 2007/0284109 | A1 | 12/2007 | East et al. |
| 2008/0000697 | A1 | 1/2008 | Rytlewski |
| 2008/0264636 | A1 | 10/2008 | Stromquist et al. |
| 2012/0085548 | A1 | 4/2012 | Fleckenstein et al. |
| 2012/0168163 | A1 | 7/2012 | Bertoja et al. |
| 2012/0312536 | A1 | 12/2012 | McCallum |
| 2013/0000926 | A1 | 1/2013 | Parrott et al. |
| 2013/0068451 | A1 | 3/2013 | Getzlaf et al. |
| 2014/0076542 | A1 | 3/2014 | Whitsitt et al. |
| 2014/0166111 | A1 | 6/2014 | Wilkin |
| 2014/0166912 | A1 | 6/2014 | Larisey et al. |
| 2014/0318815 | A1 | 10/2014 | Merron |
| 2015/0034332 | A1 | 2/2015 | Merron |

OTHER PUBLICATIONS

International Preliminary Report on Patentability issued in related PCT Application No. PCT/US2015/014779, dated Aug. 17, 2017.
"Mongoose Sand-Jet Perforating with Annular Fracs" Brochure, found at http://www.ncsmultistage.com/fracturing-systems/mongoose-sand-jet-perforating-with-annular-fracs/, NCS Multistage LLC, 3 pages.
"OptiPort Multistage Fracturing System" Brochure, Baker Hughes Incorporated, 2011, 2 pages.
"RapidForce Hs Sleeve System" Brochure, Halliburton Energy Services, Inc., 2016, 2 pages.
"RapidForce Full Straddle (FS) Sleeve System" Brochure, Halliburton Energy Services, Inc., 2015, 2 pages.
International Search Report and Written Opinion issued in related PCT Application No. PCT/US2015/014779 dated Oct. 26, 2016, 19 pages.
Search report and written opinion issued in related Singapore Application No. 11201704037Y dated Jun. 29, 2018 (10 pages).
First Examination Report issued in related Australian Application No. 2015381779 dated Jan. 23, 2018 (3 pages).
Second Examination Report issued in related Australian Application No. 2015381779 dated Jul. 5, 2018 (3 pages).

* cited by examiner

MULTI-ZONE FRACTURING WITH FULL WELLBORE ACCESS

CROSS-REFERENCE TO RELATED APPLICATION

The present application is a U.S. National Stage Application of International Application No. PCT/US2015/014779 filed Feb. 6, 2015, which is incorporated herein by reference in its entirety for all purposes.

TECHNICAL FIELD

The present disclosure relates to wellbore completion operations and, more particularly, to a system for performing fracture treatments at multiple fracture zones while maintaining a full inner diameter along a length of the wellbore.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, or remedial activities. It is common practice in completing oil and gas wells to set a string of pipe, known as casing, in the well and use a cement sheath around the outside of the casing to isolate the various formations penetrated by the well. To establish fluid communication between the hydrocarbon-bearing formations and the interior of the casing, the casing and cement sheath are perforated. Fracturing operations can then be performed through the perforated sections of the formation in order to increase the size of perforations and, ultimately, the amount and flow rate of hydrocarbons from the formation to the surface of the wellbore.

In order to selectively expose different zones of the formation along the length of the wellbore for perforation or fracturing operations, the casing can be equipped with one or more sets of sleeves disposed along an inner diameter of the casing. These sleeves can be slid out of the way to provide access to the formation at multiple different fracturing zones along the length of the wellbore. To slide the sleeves out of the way to expose a portion of the formation, an operator typically drops a ball down the wellbore, and the ball forms a plug along a decreased diameter portion of the sliding sleeve. The wellbore can then be pressurized against the plug to force the sleeve to slide downward, exposing the fracture zone of the wellbore.

In wellbores having multiple sets of sleeves for accessing different fracturing zones, the sliding sleeves can be actuated by incrementally dropped balls. Unfortunately, these dropped balls can form obstructions that must be milled out of the wellbore before a subsequent sliding sleeve can be actuated. This leads to lost time spent removing obstructions from the wellbore while performing multi-zone fracturing operations in the wellbore.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
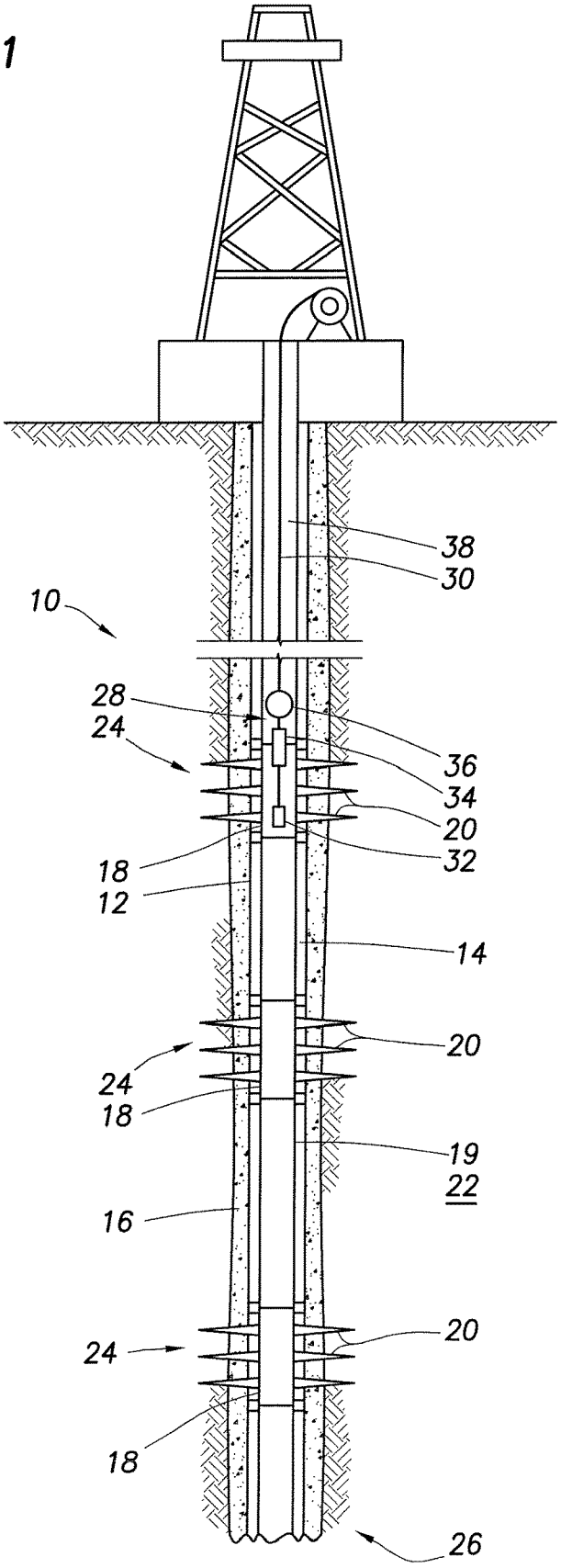
FIG. 1 illustrates a system for fracturing multiple zones along a length of a wellbore, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The present disclosure provides a system and method for fracturing multiple zones along a length of a wellbore during a single run. That is, a single shifter device may be lowered on coiled tubing to shift open multiple sets of sleeves to expose different fracture zones for desired fracturing treatments. In present embodiments, one or more sleeve assemblies may be cemented in place along a length of the wellbore to selectively provide access to a portion of the formation through which the wellbore is drilled. The shifter device may be used to selectively open and enable a fracturing operation through each of the sleeve assemblies during a single run of the shifter device through the wellbore.

In some embodiments, the sleeve assembly may include a shifting sleeve designed for engagement with expandable keys of a mechanical shifter device. The mechanical shifter device may move the shifting sleeve along the length of the wellbore in order to collapse a baffle component of the sleeve assembly. Once the baffle is collapsed, an isolation component of the shifter device may engage the collapsed baffle to form a plug through the wellbore. From here, pressure applied from the surface may push the baffle and a sliding sleeve downward, thereby exposing one or more fracturing ports through the casing of the wellbore. This enables a fracturing application to be performed through the exposed ports.

The disclosed embodiments may enable fracturing along multiple zones of a wellbore without the need for sleeves or plugs to be milled out. Instead, after fracturing one zone, the shifter device may be pulled upward and used to engage another sleeve assembly for fracturing a different zone. The disclosed sleeve assemblies may provide and maintain a fully open wellbore inner diameter prior to the shifter device being lowered through the wellbore. This may facilitate relatively simple cementing operations for cementing the sleeves in place along the wellbore and for later wiping the cement, since the wipers do not have to go through sequential baffles extending radially inward. Accordingly, the disclosed systems and methods may help to achieve multi-zone fracturing with minimal operation time while maintaining a full wellbore inner diameter.

As described in detail below, the disclosed techniques may utilize a single shifter device equipped with a plug for selectively plugging one of several sleeve assemblies disposed along a length of the wellbore. In this manner, the shifter device operates to plug the sleeve assemblies without utilizing multiple sets of packers or plug devices. This may reduce the amount of energy lost during fracturing operations due to plugging the wellbore, thereby facilitating relatively efficient operation as compared to systems that utilize multiple packer elements to block the wellbore.

Turning now to the drawings, FIG. 1 illustrates an embodiment of a multi-zone fracturing system 10. As illustrated, the system 10 may be disposed in a wellbore 12 lined with casing 14 and cement 16. The system 10 may include multiple sleeve assemblies 18 positioned in the wellbore 12 and installed along the casing 14. The sleeve assemblies 18 may be run in on a production string 19 and cemented in place. As used herein, the term "casing" is intended to be understood broadly as referring to casing and/or liners. The sleeve assemblies 18 are positioned at predetermined locations along the length of the wellbore 12. These locations may correspond to the formation of perforations 20 through the casing 14 and cement 16, and outward into a subsurface formation 22 surrounding the wellbore 12. The sleeve assemblies 18 may be selectively opened to provide access from an interior of the wellbore 12 surrounded by the casing 14 to the formation 22.

As illustrated, any number of sleeve assemblies 18 may be positioned along the length of the wellbore 12 in order to accommodate selective exposure of different zones 24 of the formation 22 to the wellbore 12. This may be particularly desirable when perforating the different zones 24 of the formation 22 or providing fracture treatments to previously formed perforations 20 at the different zones 24.

While FIG. 1 depicts the system 10 as being arranged along a vertically oriented portion of the wellbore 12, it will be appreciated that the system 10 may be equally arranged in a horizontal or slanted portion of the wellbore 12, or any other angular configuration therebetween, without departing from the scope of the disclosure. Additionally, the system 10 may be arranged along other portions of the vertical wellbore 12 in order to provide access to the formation 22 at a location closer to a toe portion 26 of the wellbore 12.

In addition to the sleeve assemblies 18 installed along the casing 14, the system 10 may include a shifting device 28 that may be lowered through the wellbore 12 and used to selectively activate the sleeve assemblies 18 to provide access to the formation 22. As illustrated, the shifting device 28 may be lowered through the wellbore 12 along coiled tubing 30. In some embodiments, a bottom hole assembly (BHA) 32 may be disposed at the bottom of the coiled tubing 30, and this BHA 32 may include sensors, communication components, a perforating gun, and/or a number of other downhole tools and equipment. In some embodiments, the BHA 32 may include the shifting device 28, while in other embodiments the shifting device 28 may be located above the BHA 32.

As described below, the shifting device 28 may include, among other things, a shifter component 34 and an isolation component 36. The shifter component 34 may be used to shift a sleeve present in the sleeve assembly 18 to collapse a baffle of the sleeve assembly, and the isolation component 36 may be used to engage with the collapsed baffle to plug a flow of fluid through the annulus 38 of the wellbore 12 surrounding the coiled tubing 30. This allows the system 10 to direct a pressurized fracturing treatment down the wellbore 12 and into the perforations 20 to further fracture the formation along a certain fracture zone 24.

Each of the sleeve assemblies 18 may include a specific number and arrangement of sleeves that may be shifted and otherwise moved to enable exposure of the formation 22 as desired. All the sleeves that make up the sleeve assemblies 18 may include a minimum inner diameter that is large enough to allow the coiled tubing 30, the BHA 32, and the shifting device 28 to pass therethrough. Thus, the disclosed system 10 may include several sleeves positioned throughout the wellbore 12 that have approximately the same inner diameter as the wellbore 12. This may allow any number of sleeve assemblies 18 to be placed into the wellbore 12 without affecting the ability to cement the entire string of casing 14 and sleeve assemblies 18.

Figure 2:
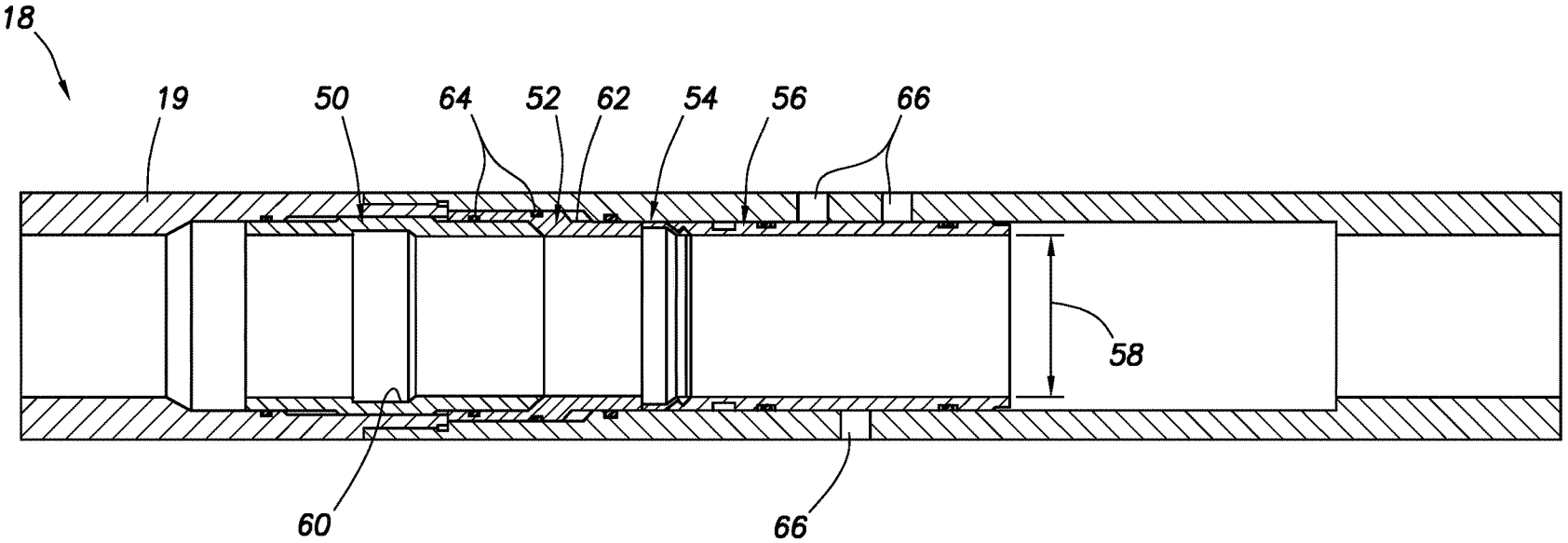
FIG. 2 is a cross-sectional view of a sleeve assembly for use in a fracturing zone, in accordance with an embodiment of the present disclosure.

Having generally described the context in which the disclosed multi-zone fracturing system 10 may be utilized, a more detailed description of the components that make up the system 10 will be provided. To that end, FIG. 2 illustrates an embodiment of the sleeve assembly 18 that may be disposed at one or more positions along the length of the wellbore 12. In the illustrated embodiment, the sleeve assembly 18 includes a shifting sleeve 50, an air chamber piston sleeve 52, a collapsible baffle 54, and a baffle insert/sliding sleeve 56.

As mentioned above, each of these sleeves/baffles 50, 52, 54, and 56 that make up the sleeve assembly 18 may feature approximately the same minimum diameter dimension 58 at the point of each sleeve/baffle having the smallest inner diameter, when the sleeve assembly 18 is not activated. As described below, the sleeve assembly 18 may be selectively activated via the shifting device 28 of FIG. 1 to collapse the baffle 54 inwardly for shifting the sliding sleeve 56 out of the way.

In the illustrated embodiment, the shifting sleeve 50 may include an internal engagement feature 60 for coupling a corresponding mechanical engagement feature of the shifting device 28 with the shifting sleeve 50. In some embodiments, an inner diameter portion of the shifting sleeve 50 may extend downward to cover both the air chamber piston sleeve 52 and the baffle 54. The air chamber piston sleeve 52 may be partially disposed in an air chamber 62 formed between the shifting sleeve 50 and the collapsible baffle 54, as illustrated. O-ring seals 64 may be disposed along opposing sides of the air chamber piston sleeve 52 to maintain the air chamber piston sleeve 52 as a piston component within the chamber 62.

The baffle 54 may be initially positioned between the shifting sleeve 50 and the sliding sleeve 56 in a radially open position, as illustrated. The baffle 54 may be a collapsible component that is initially held against an engagement surface of the sliding sleeve 56 via a spring force applied to the baffle 54. In the illustrated embodiment, the baffle 54 includes a notched feature for engaging a similarly shaped notch feature along the upper edge of the sliding sleeve 56. In other embodiments, different engagement components may be used to initially hold the collapsible baffle 54 in place against the sliding sleeve 56. The sliding sleeve 56 may be initially disposed over a plurality of ports 66 formed through the casing or production string 19, in order to prevent fluid from flowing between the wellbore 12 and the formation 22.

Figure 3A:
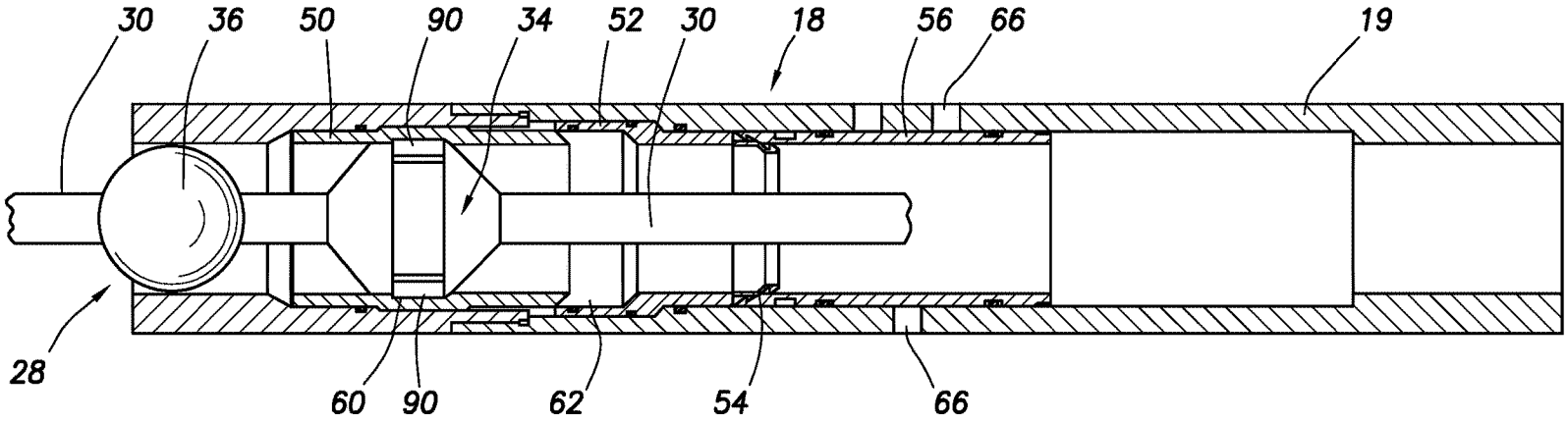
FIGS. 3A-3B show a cross-sectional view of a mechanical shifter lowered on coiled tubing being used to activate the sleeve assembly of FIG. 2, in accordance with an embodiment of the present disclosure.
Figure 3B:
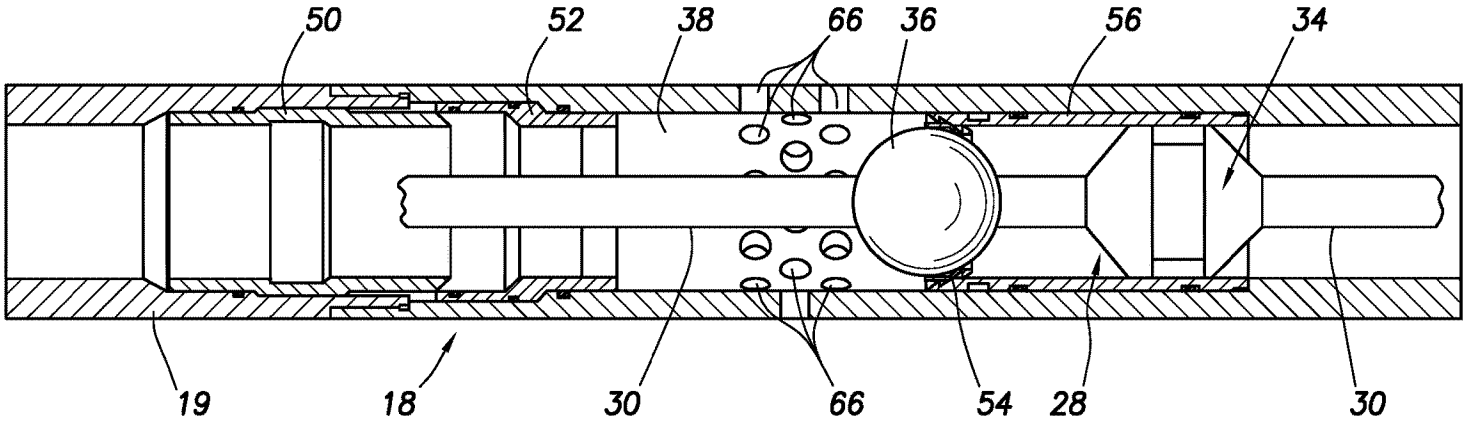

FIGS. 3A and 3B illustrate an embodiment of the shifting device 28 of FIG. 1 being used to selectively actuate the sleeve assembly 18 open to enable fluid flow between the wellbore 12 and the formation 22 via the ports 66. As mentioned above, the shifting device 28 may include the shifting component 34 and the isolation component 36 disposed next to each other along a length of coiled tubing 30 that may be lowered through the wellbore 12. In the illustrated embodiment, the shifting component 34 may include a mechanical shifting component having expandable keys 90 that may be expanded outward in response to a pressure applied through an inner diameter of the coiled tubing 30. The shifting component 34 may use the expandable keys 90 to latch onto the engagement feature 60 of the shifting sleeve 50 to activate the sleeve assembly 18.

Again, the isolation component 36 may be located above the shifting component 34 on the coiled tubing 30. The isolation component 36 may include a ball (as illustrated) or a plug-like object to engage the collapsible baffle 54. More specifically, the isolation component 36 may be designed with an outside diameter that is sized to give an adequate interference with the collapsed inner diameter of the baffle 54 (after the baffle 54 is collapsed). Thus, the isolation component 36 may be used to provide a desired and effective zonal isolation down the annulus 38 of the wellbore 12.

The shifting device 28 (run in on coiled tubing 30) in combination with the sleeve assembly 18 may be used to provide selective isolation of the wellbore 12 and access to the formation 22 for performing fracture operations via the ports 66. In addition, a single shifting device 28 run in on the coiled tubing 30 may be used to selectively isolate any one of multiple sleeve assemblies 18 positioned at different fracture zones along the length of the wellbore 12 (as shown in FIG. 1). To that end, the shifting device 28 may be run downhole via the coiled tubing 30 until it reaches the furthest sleeve assembly 18 in the completion string 19, this furthest sleeve assembly 18 being located closest to the toe of the wellbore 12. In some embodiments, the shifting device 28 and/or the sleeve assembly 18 may include a locating device or a casing collar locator (CCL) to detect and provide feedback to stop the coiled tubing from advancing further down the wellbore 12 after the shifting device 28 has reached the desired sleeve assembly 18.

Upon reaching the desired sleeve assembly 18, the coiled tubing 30 may be lowered slightly past the sleeve assembly 18 until the shifting component 34 is below the shifting sleeve 50. Pressure may then be applied through the inner diameter of the coiled tubing 30 to expand the keys 90 of the hydraulic shifting component 34. Once the keys 90 are expanded outward, the coiled tubing 30 may be raised until the expanded keys 90 are received into with the engagement feature 60 of the shifting sleeve 50. As the coiled tubing 30 is moved up further, the shifting component 34 may raise the shifting sleeve 50 upward through the wellbore 12 relative to the other sleeves, as shown in FIG. 3A.

Moving the shifting sleeve 50 upward in this manner may cause the baffle 54 to collapse from the radially open position into a radially collapsed position against the sliding sleeve 56, as shown. Specifically, in the illustrated embodiment, the shifting sleeve 50 may be shifted upward beyond the O-ring 64 that had before been used to seal the shifting sleeve 50 against the air chamber piston sleeve 52. This may cause pressure in the atmospheric air chamber 62 to force the air chamber piston sleeve 52 downward. The air chamber piston sleeve 52 may exert a downward force on the baffle 54 that causes the baffle 54 to collapse inward and into the sliding sleeve 56.

Once the baffle 54 is collapsed, the coiled tubing 30 may proceed downward to lock the isolation component 36 into the collapsed baffle 54. The collapsed baffle 54 may then create a seal with the isolation component 36 located above the shifting component 34. With this seal created, a combination of weight from the coiled tubing 30 and internal pressure within the sleeve assembly 18 may cause the baffle insert/sliding sleeve 56 to shift downwards and expose the fracture treatment ports 66, as shown in FIG. 3B. From this position, any desirable fracturing treatments may be carried out down the annulus 38 of the coiled tubing 30.

At this point, the shifting component 34 may located below the seal created via the isolation component 36 engaging with the baffle 54. This may protect the shifting component 34 from abrasive fluids that may be pumped down the annulus 38 during the fracturing operations, allowing for repeated use of the shifting device 28. Once the zone has been completed via the fracturing treatment through the ports 66, the coiled tubing 30 and shifting device 28 coupled thereto may move up to the next sleeve assembly 18 along the length of the wellbore 12. From here the shifting device 28 may similarly activate the sleeve assembly 18 to enable fracture treatments to be performed through the sleeve assembly 18 at another zone.

Figure 4:
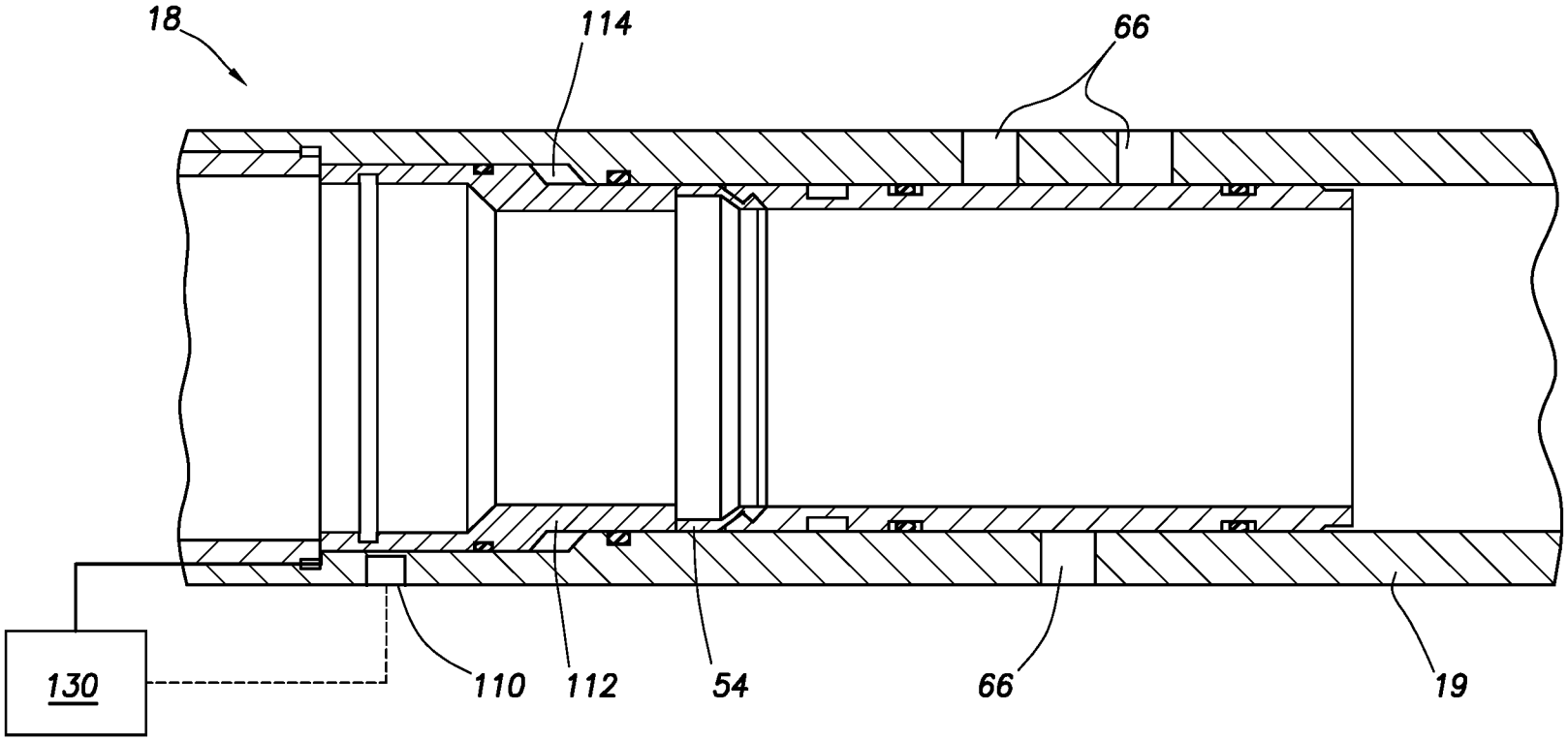
FIG. 4 is a cross-sectional view of a sleeve assembly for use in a fracturing zone, in accordance with an embodiment of the present disclosure.

Other types of sleeve assemblies 18 and corresponding shifting devices 28 may be utilized in other embodiments to provide selective isolation of a fracture zone of the wellbore 12. For example, FIG. 4 illustrates a sleeve assembly 18 that may be magnetically actuated via a corresponding magnetic shifting device 28 run in on the coiled tubing 30. The sleeve assembly 18 may be equipped with a reliable magnetic sensing system 110 that may be used to detect the magnetic shifting device 28 run in on the coiled tubing 30. In addition to the magnetic sensing system 110, the sleeve assembly 18 may include an oil chamber piston sleeve 112, the collapsible baffle 54, and the baffle insert/sliding sleeve 56. The oil chamber piston sleeve 112 may be partially disposed in a sealed oil chamber 114 of the sleeve assembly 18, and the oil chamber piston sleeve 112 may act similarly to the air chamber piston sleeve 52 of FIG. 2.

Some embodiments of the sleeve assembly 18 may also include an additional sleeve (not shown) that covers a radially inner side of the oil chamber piston sleeve 112 and the collapsible baffle 54. Such a sleeve would be similarly shaped to the shifting sleeve 50 of FIG. 2. This additional sleeve may be hydraulically locked, such that once the pin pusher of an electro-hydraulic lock 130 is fired, the sleeve may shift to expose the oil chamber piston sleeve 112. The additional sleeve may also be used to protect the baffle 54 from erosion.

Figure 5A:
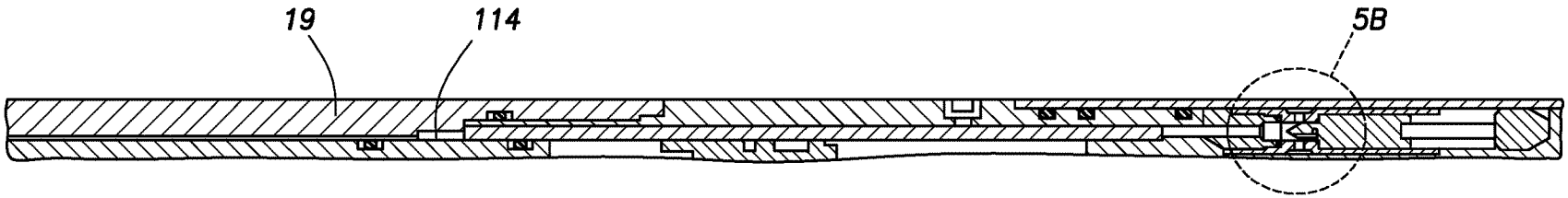
FIGS. 5A-5B show a cross-sectional view of an electro-hydraulic lock that can be used with the sleeve assembly of FIG. 4, in accordance with an embodiment of the present disclosure.
Figure 5B:
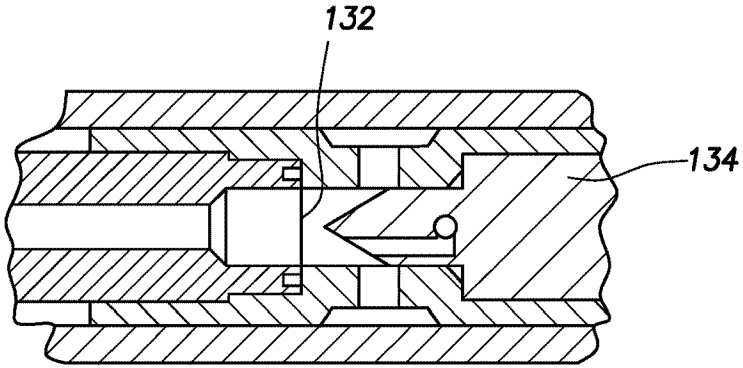

In addition to these components, the system may utilize an electro-hydraulic lock 130 to actuate the sleeve assembly 18, as shown in FIG. 5A. The electro-hydraulic lock 130 may be disposed in another sleeve or housing component that is cemented in place adjacent the sleeve assembly 18. The electro-hydraulic lock 130 of FIG. 5B may include a rupture disc 132 and a pin pusher 134. The rupture disc 132 may act as a fluid barrier to lock the oil chamber piston sleeve 112 in place within the sleeve assembly 18 of FIG. 4.

Once a desired magnetic signal is detected via the magnetic sensing system 110 of the sleeve assembly 18, the magnetic sensing system 110 may output a control signal to fire the pin pusher 134 into contact with the rupture disc 132. The impact of the pin pusher 134 may pierce the rupture disc 132, expelling locking fluid (e.g., oil) from the electro-hydraulic lock 130 into the oil chamber 114 to facilitate downward movement of the oil chamber piston sleeve 112. The disclosed electro-hydraulic lock 130 may have relatively low power requirements, making it especially desirable for such downhole applications.

Figure 8B:
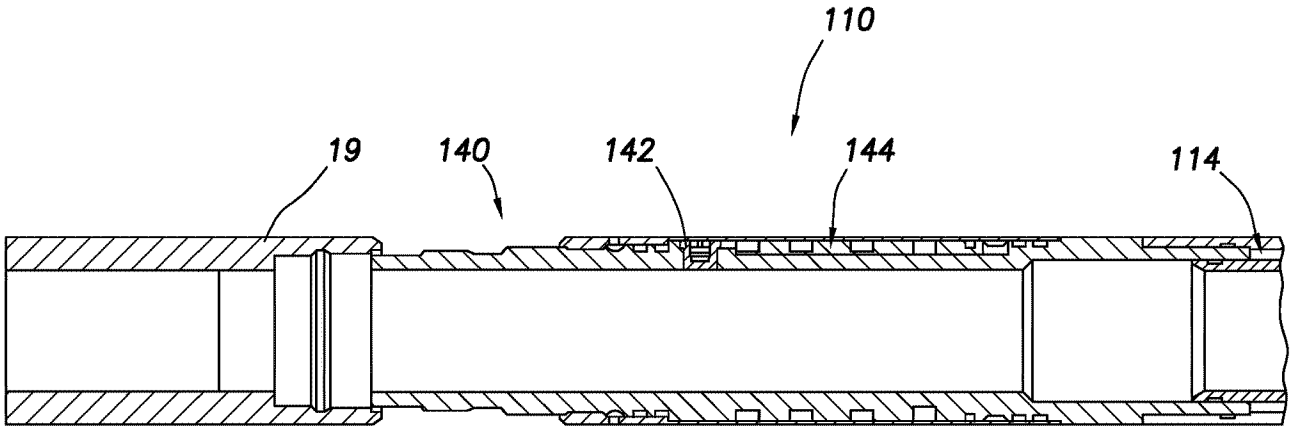
FIGS. 8A-8C illustrate various cross sectional views of the sleeve assembly of FIG. 4 having a magnetic sensing system and an electro-hydraulic lock, in accordance with an embodiment of the present disclosure.
Figure 8C:
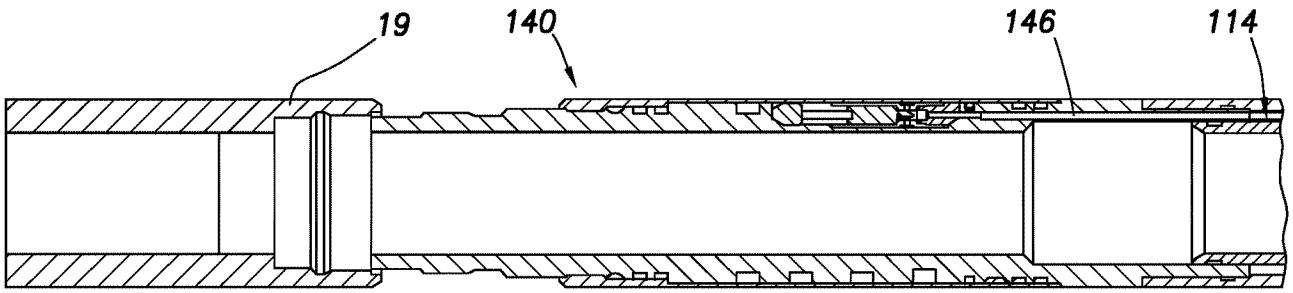
Figure 8A:
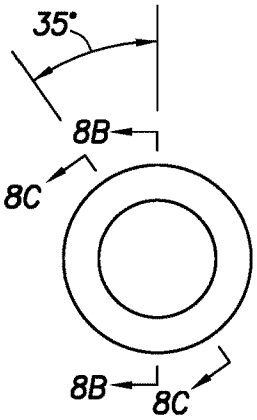

Certain embodiments of the sleeve assembly 18 having the magnetic sensing system 110 and the electro-hydraulic lock 130 may be arranged as shown in FIGS. 8A-8C. As illustrated, the magnetic sensing system 110 may be disposed in a portion 140 of the sleeve assembly 18 disposed between the production string 19 and the oil chamber 114 in which the oil chamber piston sleeve 112 is disposed. This portion 140 of the sleeve assembly 18 may include additional sleeves that are coupled together to define chambers, flow paths, and housings for the components of the magnetic sensing system 110 and electro-hydraulic lock 130. In other embodiments, the magnetic sensing system 110 may be disposed directly within a section of the production string 19.

The magnetic sensing system 110 may include a magnetic sensor 142 disposed in an inner wall of the portion 140 of the sleeve assembly 18. In some embodiments, the magnetic sensor 142 may be disposed in one of the other sleeves (e.g., 112, 56) of the sleeve assembly 18, or within a section of the production string 19. Wherever the magnetic sensor 142 is disposed, it may be positioned along an innermost edge of the sleeves or tubing defining the wellbore 12, in order to maintain a relatively clear and unobstructed sensing range for sensing a magnetic device moving through the wellbore 12. In some embodiments, the magnetic sensor 142 may be disposed in a plug formed through the portion 140 of the sleeve assembly 18. The plug may be constructed from Inconel, or some other material designed to remain in place at high temperatures such as those experienced downhole. The Inconel plug may provide a magnetic window for the sensor 142 to detect a magnetic field emitted from a magnet or other component being moved through the wellbore 12.

The magnetic sensing system 110 may also include an electronics module disposed in an electronics chamber 144 formed through the portion 140 of the sleeve assembly 18. In other embodiments, the electronics chamber 144 may be disposed in other positions within the sleeve assembly 18 and/or the production string 19. The magnetic sensor 142 may be communicatively coupled to the onboard electronics. These electronics may receive the detected magnetic signal from the magnetic sensor 142 and determine an appropriate control signal to send to the electro-hydraulic lock 130 in response to the detected magnetic signal. For example, the electronics may be programmed to output a control signal for firing the electro-hydraulic lock 130 in response to detecting a magnetic component passing the magnetic sensor 142, or in response to detecting the magnetic component passing the sensor a desired number of times.

As illustrated, the electro-hydraulic lock 130 may also be positioned within the portion 140 of the sleeve assembly 18. In some embodiments, the electro-hydraulic lock 130 may be disposed in a position that is rotationally offset from the magnetic sensing system 110 disposed in the sleeve assembly 18. This may enable the magnetic sensing system 110 to more easily communicate signals from the electronics module 144 to the electro-hydraulic lock 130. Upon receiving the control output signal from the electronics module 144, the electro-hydraulic lock 130 may fire the pin pusher into the rupture disc of the hydraulic lock 130. The impact of the pin pusher may pierce the rupture disc, expelling locking fluid (e.g., oil) from the electro-hydraulic lock 130 into a passageway 146 leading to the oil chamber 114. Again, other arrangements of these and other components may be utilized in other embodiments of the disclosed sleeve assembly 18.

Figure 6A:
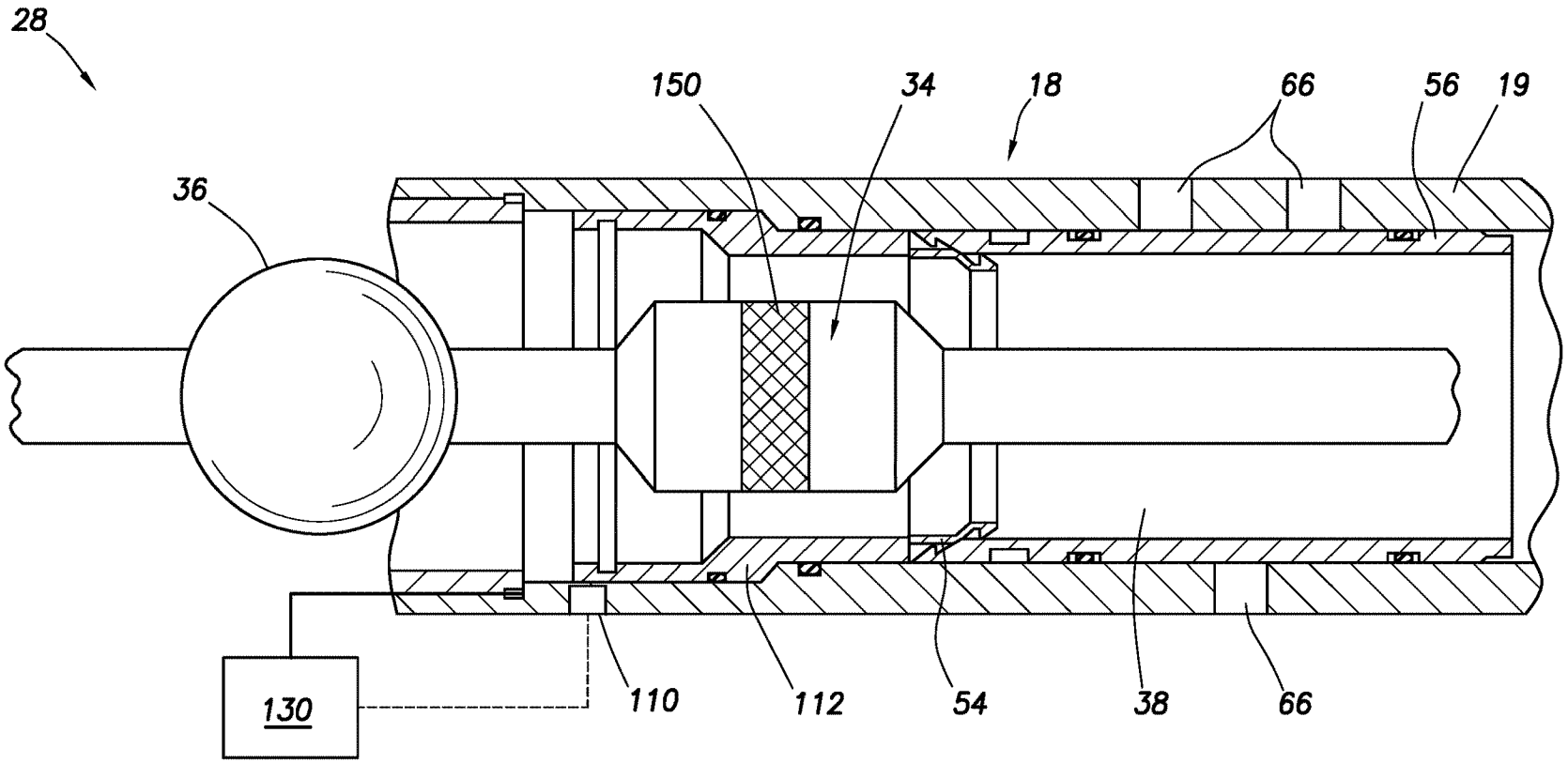
FIGS. 6A-6B show a cross-sectional view of a magnetic shifter lowered on coiled tubing being used to activate the sleeve assembly of FIG. 4, in accordance with an embodiment of the present disclosure.
Figure 6B:
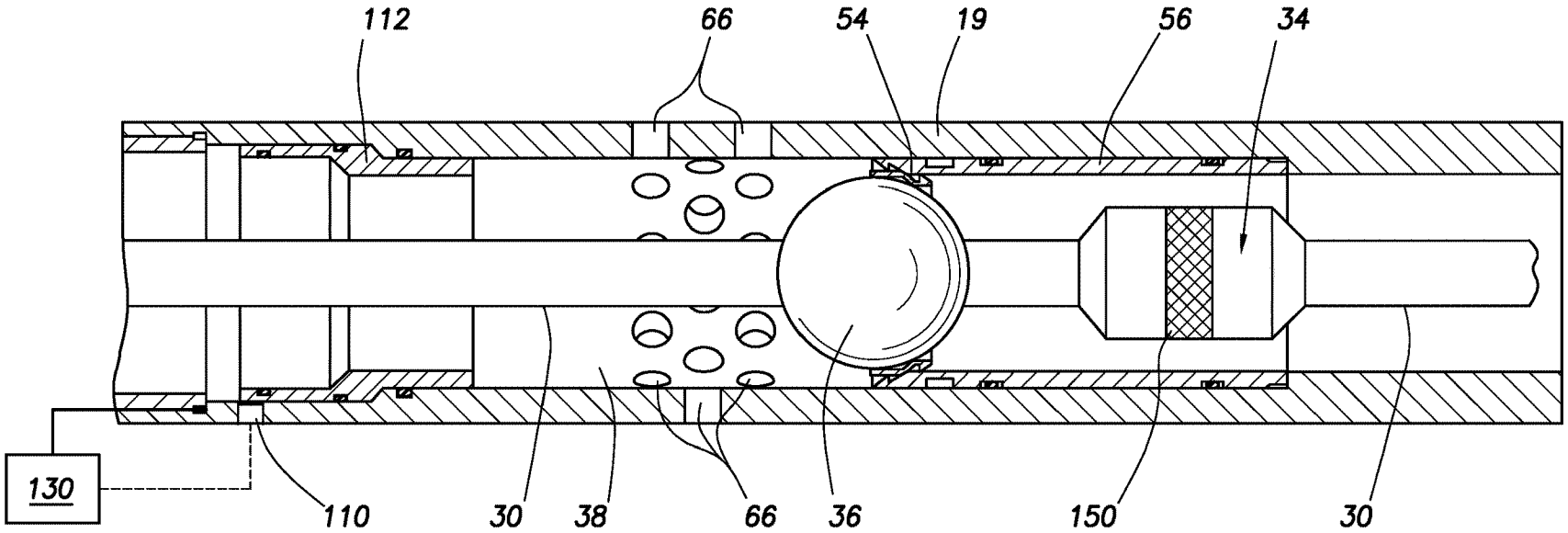

FIGS. 6A and 6B illustrate an embodiment of the shifting device 28 of FIG. 1 being used to selectively actuate the magnetic sleeve assembly 18 open to enable fluid flow between the wellbore 12 and the formation 22 via the ports 66. As mentioned above, the shifting device 28 may include the shifting component 34 and the isolation component 36 disposed next to each other along a length of coiled tubing 30 that may be lowered through the wellbore 12. In the illustrated embodiment, the shifting component 34 may include a magnetic shifting component having a magnet 150 or another component with the ability to generate a magnetic field. The shifting component 34 may use the magnet 150 to signal to the magnetic sensing system 110 to activate the sleeve assembly 18.

Again, the isolation component 36 may be located above the shifting component 34 on the coiled tubing 30. The isolation component 36 may include a ball (as illustrated) or a plug-like object to engage the collapsible baffle 54. More specifically, the isolation component 36 may be designed with an outside diameter that is sized to give an adequate interference with the collapsed inner diameter of the baffle 54 (after the baffle 54 is collapsed). Thus, the isolation component 36 may be used to provide a desired and effective zonal isolation down the annulus 38 of the wellbore 12.

The magnetic shifting device 28 (run in on coiled tubing 30), in combination with the magnetic sleeve assembly 18 and the electro-hydraulic lock 130, may be used to provide selective isolation of the wellbore 12 and access to the formation 22 for performing fracture operations via the ports 66. In addition, a single magnetic shifting device 28 run in on the coiled tubing 30 may be used to selectively isolate any one of multiple sleeve assemblies 18 positioned at different fracture zones along the length of the wellbore 12 (as shown in FIG. 1).

To facilitate this, each of the sleeve assemblies 18 may be programmed at the surface prior to the sleeve assemblies 18 being run in on the production string 19. Specifically, executable instructions may be programmed into a memory of the magnetic sensing system 110. A processor in the magnetic sensing system may execute the instructions to determine whether the magnetic shifting device 28 has passed the sleeve assembly 18, based on sensor data collected via a sensor in the magnetic sensing system 110. The processor may then output control signals to the electro-hydraulic lock 130 to actuate the pin pusher described above.

After the sleeve assemblies 18 are programmed, they may be lowered into the wellbore 12 on the production string 19 and cemented into place adjacent the desired fracturing zones. After this, the magnetic shifting device 28 may be run downhole via the coiled tubing 30 until it reaches the furthest sleeve assembly 18 in the completion string 19, this furthest sleeve assembly 18 being located closest to the toe of the wellbore 12. Once the BHA of the coiled tubing 30 has passed through every sleeve assembly 18, the coiled tubing 30 may be pulled up slowly so that the magnetic field shifting component 34 passes through the first sleeve (closest to the toe of the wellbore 12) a second time.

Upon this second detection of the magnetic field from the shifting component 34, the electronics in the magnetic sensor system 110 may signal to the electro-hydraulic lock 130 to fire the pin pusher, thereby unlocking the oil chamber piston sleeve 112. This may force the oil chamber piston sleeve 112 downward (due to differential pressure across the sleeve), as shown in FIG. 6A. The oil chamber piston sleeve 112 may exert a downward force on the baffle 54 that causes the baffle 54 to collapse inward and into the sliding sleeve 56.

Once the baffle 54 is collapsed, the coiled tubing 30 may proceed downward to lock the isolation component 36 into the collapsed baffle 54. The collapsed baffle 54 may then create a seal with the isolation component 36 located above the shifting component 34. With this seal created, a combination of weight from the coiled tubing 30 and internal pressure within the sleeve assembly 18 may cause the baffle insert/sliding sleeve 56 to shift downwards and expose the fracture treatment ports 66, as shown in FIG. 6B. From this position, any desirable fracturing treatments may be carried out down the annulus 38 of the coiled tubing 30.

As mentioned above, the magnetic shifting component 34 may be located below the seal created via the isolation component 36 engaging with the baffle 54. This may protect the magnetic shifting component 34 from abrasive fluids that may be pumped down the annulus 38 during the fracturing operations, allowing for repeated use of the magnetic shifting device 28. Once the zone has been completed via the fracturing treatment through the ports 66, the coiled tubing 30 and shifting device 28 coupled thereto may move up to the next sleeve assembly 18 along the length of the wellbore 12. From here the magnetic shifting device 28 may similarly activate the sleeve assembly 18 to enable fracture treatments to be performed through the sleeve assembly 18 at another zone.

Figure 7:
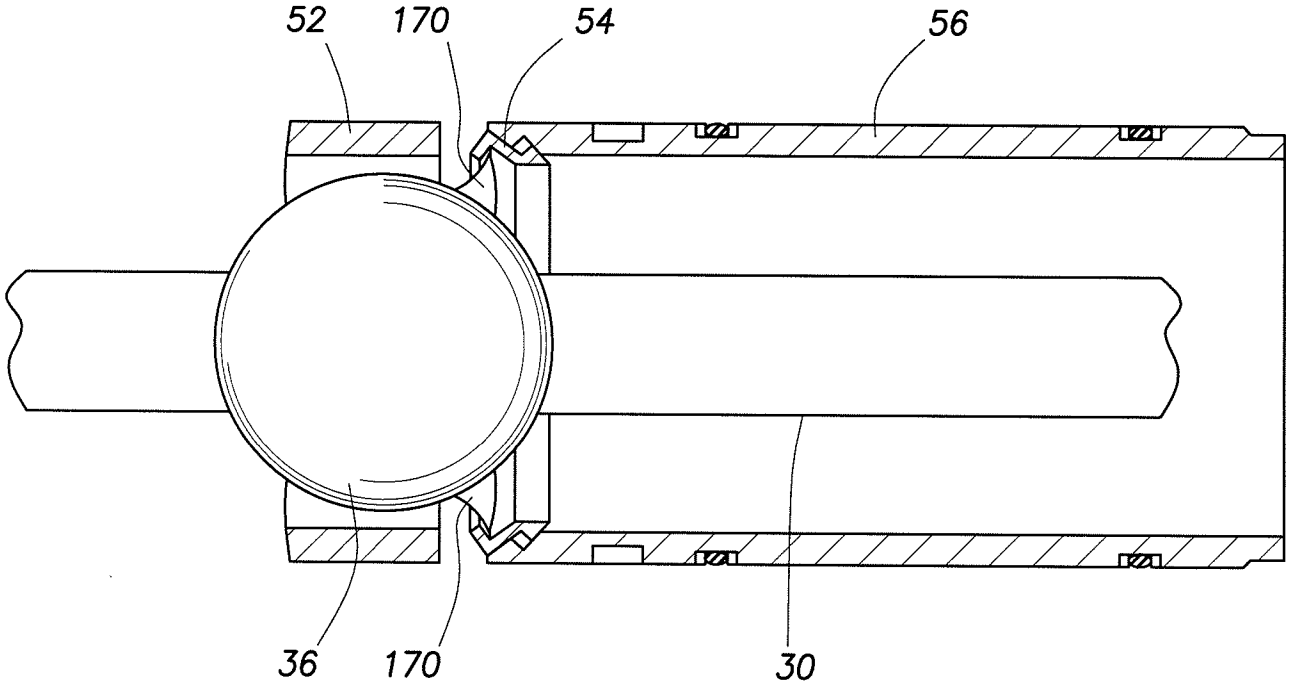
FIG. 7 is a schematic view of a shifter that may be used to engage a baffle in a sleeve assembly, in accordance with an embodiment of the present disclosure.

In either of the embodiments illustrated in FIGS. 3 and 6, the isolation component 36 may include a mating feature 170 designed to mate with a corresponding feature of the baffle 54, as illustrate in FIG. 7. The mating feature 170 may allow the isolation component 36 to lock into the baffle 54 while a fracture treatment is performed downhole. When the fracturing treatment is completed and the coiled tubing 30 moves up, the coiled tubing 30 may transmit a load to the collapsed baffle due to the mating feature 170. This force may cause the baffle 54 to spring back out into its full wellbore inner diameter position (e.g., shown in FIGS. 2 and 4).

In addition, in either of the embodiments illustrated in FIGS. 3 and 6, the collapsible baffle 54 may be constructed from a degradable alloy designed to dissolve or significantly degrade when brought into contact with downhole fluids (e.g., wellbore fluids, fracturing fluids, or formation fluids). As mentioned above, one or more of the sleeves (e.g., shifting sleeve 50 of FIG. 2) may be used to cover the baffle 54 in order to keep the baffle 54 from eroding in the presence of downhole fluids. Once the degradable baffle 54 collapses and the fracture zone is treated, the baffle 54 may degrade in the downhole fluid over time.

In some embodiments of the mechanical and magnetic systems described above, the sleeve assembly 18 may not feature ports 66 formed therein at all, but instead may be used in conjunction with the shifting device 28 to isolate a particular zone of the formation 22. In such instances, the shifting device 28 may be used to slide open the sliding sleeve 56 and to isolate the portion of the wellbore 12 adjacent the zone. A cutting tool may be used at this point to perforate the isolated zone of the formation 22. In other embodiments, the sleeve assembly 18 may include the ports 66, but in the event that the sliding sleeve 56 malfunctions and does not uncover the ports 66, a cutting tool may be used to perforate the isolated zone of the formation 22. To that end, the shifting device 28 may be built into and function integrally with a jet cutting or abrasive cutting tool run in on the coiled tubing 30.

As mentioned above with reference to FIG. 1, in such embodiments the shifting device 28 may be formed into the BHA 32 (at the bottom of the coiled tubing 30) having an appropriate cutting mechanism. This type of system may allow operators to fracture multiple zones quickly while maintaining a full wellbore inner diameter along the sleeve assemblies 18 and without needing to mill out objects downhole after completing the fracture job. The system may also allow operators to treat multiple zones without having the pull the coiled tubing 30 and BHA 32 out of the wellbore 12. Instead, the coiled tubing 30 may be run into the wellbore 12 once, eliminating time and costs associated with pulling the coiled tubing 30 out of the wellbore 12 and redressing the BHA 32.

Although the present disclosure and its advantages have been described in detail, it should be understood that various changes, substitutions and alterations can be made herein without departing from the spirit and scope of the disclosure as defined by the following claims.

What is claimed is:

1. A system comprising a sleeve assembly for use in a wellbore, the sleeve assembly comprising:

a shifting sleeve comprising an engagement mechanism for coupling the shifting sleeve to a mechanical shifting component lowered through the sleeve assembly;

a collapsible baffle moveable from a radially open position to a radially collapsed position in response to movement of the shifting sleeve, wherein the radially collapsed position is sized for receiving an isolation component lowered through the sleeve assembly, the mechanical shifting component being attached to the isolation component via coiled tubing; and a sliding sleeve disposed adjacent the collapsible baffle and moveable to expose ports for providing access to a formation from inside the wellbore, in response to force from the isolation component engaged with the collapsible baffle.

2. The sleeve assembly of claim 1, further comprising an air chamber piston sleeve partially disposed in an air chamber adjacent the shifting sleeve, wherein the air chamber piston sleeve is moveable in a downhole direction through the air chamber in response to the shifting sleeve being shifted in an uphole direction relative to the air chamber piston sleeve such that pressure in the atmospheric chamber forces the air chamber piston sleeve in the downhole direction, and wherein the collapsible baffle is moveable in response to movement of the air chamber piston sleeve in the downhole direction.

3. The sleeve assembly of claim 2, wherein the shifting sleeve, the air chamber piston sleeve, the collapsible baffle in the radially open position, and the sliding sleeve each have a minimum inner diameter large enough to accommodate the mechanical shifting component and the isolation component moving through the sleeve assembly.

4. The sleeve assembly of claim 1, wherein the shifting sleeve extends toward and covers the collapsible baffle when the collapsible baffle is in the radially open position.

5. The sleeve assembly of claim 1, wherein the baffle comprises a material that is degradable when exposed to downhole fluids.

6. A system, comprising:

a sleeve assembly comprising a collapsible baffle and a sliding sleeve disposed adjacent the collapsible baffle, wherein the collapsible baffle is moveable from a radially open position to a radially collapsed position; and a shifting device disposed on coiled tubing, the shifting device comprising:

a mechanical shifting component comprising an engagement feature to activate the sleeve assembly to collapse the baffle; and an isolation component comprising a plug or ball shaped to seat in the collapsible baffle when the collapsible baffle is in the radially collapsed position, and wherein the sliding sleeve is moveable to expose ports providing access to a formation from inside a wellbore in response to force from the isolation component on the collapsible baffle;

wherein the mechanical shifting component and the isolation component are attached to each other via the coiled tubing.

7. The system of claim 6, wherein the sleeve assembly further comprises a shifting sleeve disposed adjacent the collapsible baffle, wherein the mechanical shifting component comprises the engagement feature for releasably coupling to the shifting sleeve, and wherein the collapsible baffle is moveable in response to movement of the shifting sleeve.

8. The system of claim 7, further comprising an air chamber piston sleeve partially disposed in an air chamber adjacent the shifting sleeve, wherein the air chamber piston sleeve is moveable through the air chamber in response to a movement of the shifting sleeve via the mechanical shifting component, and wherein the collapsible baffle is moveable from the radially open position to the radially collapsed position in response to movement of the air chamber piston sleeve.

9. The system of claim 6, further comprising a plurality of sleeve assemblies, each of the plurality of sleeve assemblies comprising a respective collapsible baffle and sliding sleeve; and the shifting device for selectively activating each of the plurality of sleeve assemblies.

10. The system of claim 6, further comprising an engagement feature for selectively coupling the isolation component to the collapsible baffle in the radially collapsed position.

11. The system of claim 6, wherein the isolation component is disposed above the mechanical shifting component in the shifting device.

12. A method, comprising:

releasably engaging a shifting sleeve disposed in a wellbore via a mechanical engagement feature of a shifting device disposed on coiled tubing;

moving the shifting sleeve via the shifting device engaged with the shifting sleeve;

collapsing a baffle from a radially open position to a radially collapsed position against an inner diameter of a sliding sleeve, in response to movement of the shifting sleeve;

engaging the collapsed baffle via an isolation component on the shifting device; and moving the sliding sleeve along the wellbore to expose ports for providing access to a formation from inside the wellbore in response to a force from the isolation component on the baffle;

wherein the mechanical engagement feature and the isolation component are attached to each other via the coiled tubing.

13. The method of claim 12, further comprising exposing multiple fracture zones by moving the sliding sleeves of a plurality of sleeve assemblies disposed along a length of the wellbore via a single shifting device disposed on the coiled tubing in a single downhole trip.

14. The method of claim 12, further comprising actuating a downward movement of an air chamber piston sleeve based on a pressure differential caused by movement of the shifting sleeve, in order to collapse the baffle via the air chamber piston sleeve.

15. The method of claim 12, further comprising returning the baffle from the radially collapsed position to the radially open position via the isolation component.

16. The method of claim 12, further comprising maintaining a fully open wellbore inner diameter through the shifting sleeve, the collapsible baffle, and the sliding sleeve prior to movement of the shifting sleeve via the shifting device.

17. The method of claim 12, wherein releasably engaging the shifting sleeve via the shifting device comprises pressurizing down the coiled tubing to expand keys extending from the shifting device to engage an inner diameter of the shifting sleeve.

18. The method of claim 12, further comprising blocking the mechanical engagement feature of the shifting device from downhole fluids via the isolation component engaged with the baffle.

* * * * *